United States Patent [19]

Young et al.

[11] 4,065,761

[45] Dec. 27, 1977

[54] ELECTRICAL INSTALLATION FOR FIRE ENGINE TOWER OR THE LIKE

[75] Inventors: Richard E. Young, Lancaster; Timothy D. Ostolski, Buffalo, both of N.Y.

[73] Assignee: Young Fire Equipment Corporation, Lancaster, N.Y.

[21] Appl. No.: 656,345

[22] Filed: Feb. 9, 1976

[51] Int. Cl.[2] ..... G08B 21/00; H01R 39/00

[52] U.S. Cl. ..... 340/271; 339/5 RL; 340/267 R; 340/282

[58] Field of Search ..... 340/271, 267 R, 267 C, 340/282; 339/2 A, 2 R, 2 L, 2 RL, 5 R, 5 RL

[56] References Cited

U.S. PATENT DOCUMENTS

| | | | |
|---|---|---|---|
| 2,815,501 | 12/1957 | Benson et al. | 340/282 |
| 2,955,271 | 10/1960 | Dawkins | 339/2 L |
| 3,234,449 | 2/1966 | Lang et al. | 340/271 |
| 3,456,810 | 7/1969 | Ely | 340/267 C |
| 3,760,401 | 9/1973 | Tallon | 340/271 |
| 3,763,455 | 10/1973 | Confer et al. | 339/5 RL |
| 3,965,464 | 6/1976 | Kozai | 340/267 C |

FOREIGN PATENT DOCUMENTS

| | | | |
|---|---|---|---|
| 220,001 | 5/1958 | Australia | 339/2 L |

*Primary Examiner*—Glen R. Swann, III
*Attorney, Agent, or Firm*—Joseph P. Gastel

[57] ABSTRACT

A construction for a fire engine body or the like including a body and a rotatable tower mounted on the body, and a continuous wiring connection between the body and the rotatable tower including a large diameter drum mounting a wire ribbon which extends onto a small diameter drum rotatable with the tower whereby multiple rotations of the small drum can be experienced for each rotation of the large drum to thereby permit a continuous wire to extend between the body and the rotatable tower, and a signal arrangement for indicating the amount the tower has rotated from a neutral position.

14 Claims, 8 Drawing Figures

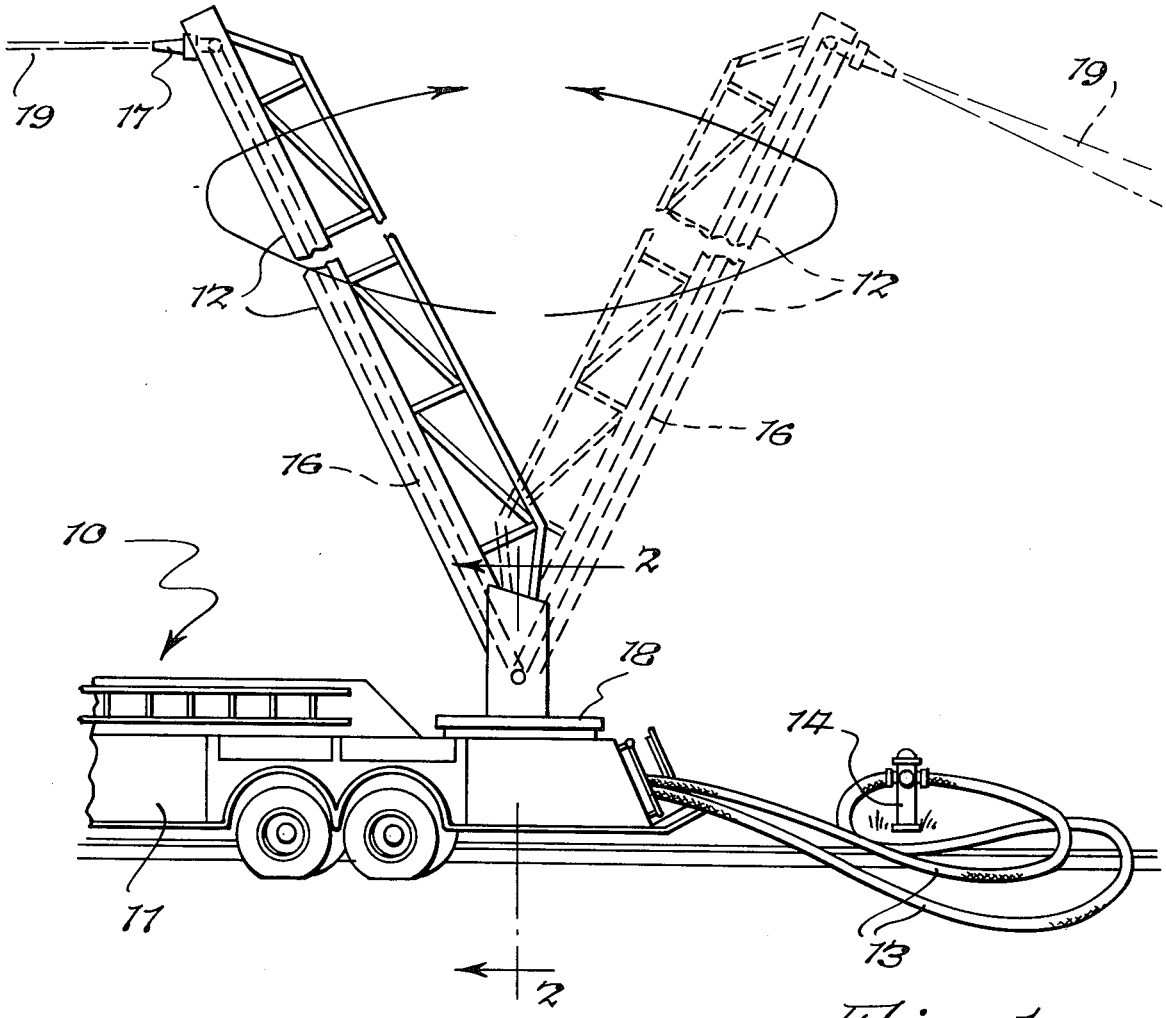
Fig. 1.
Fig. 7.
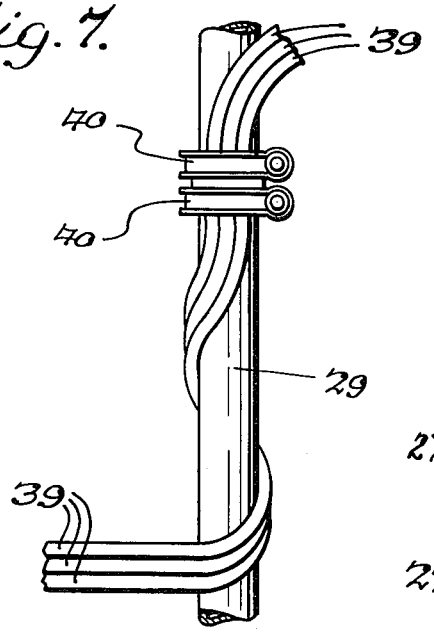
Fig. 8.
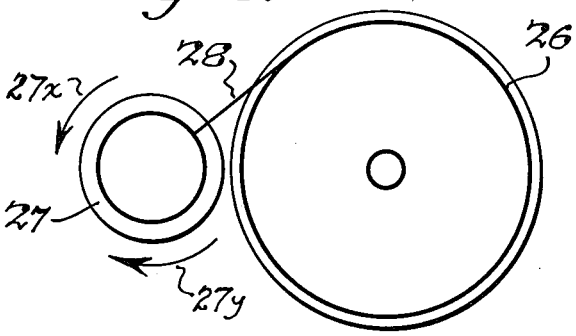

16
28t
22
61
11a
11a
54
21
55
54'
56
56
55
28v
60
3
52
27
57'
53
60'
58
58'
28h
57
54'
55'
42
50
26
30
30'
11'
32
25
47
41
47'
49
28
3
39
43
48
45
48'
40
20
29
11
39
L1
L2
65
66
37'
35'
37
15
35
36
37
34
33
11''
34

Fig. 3.
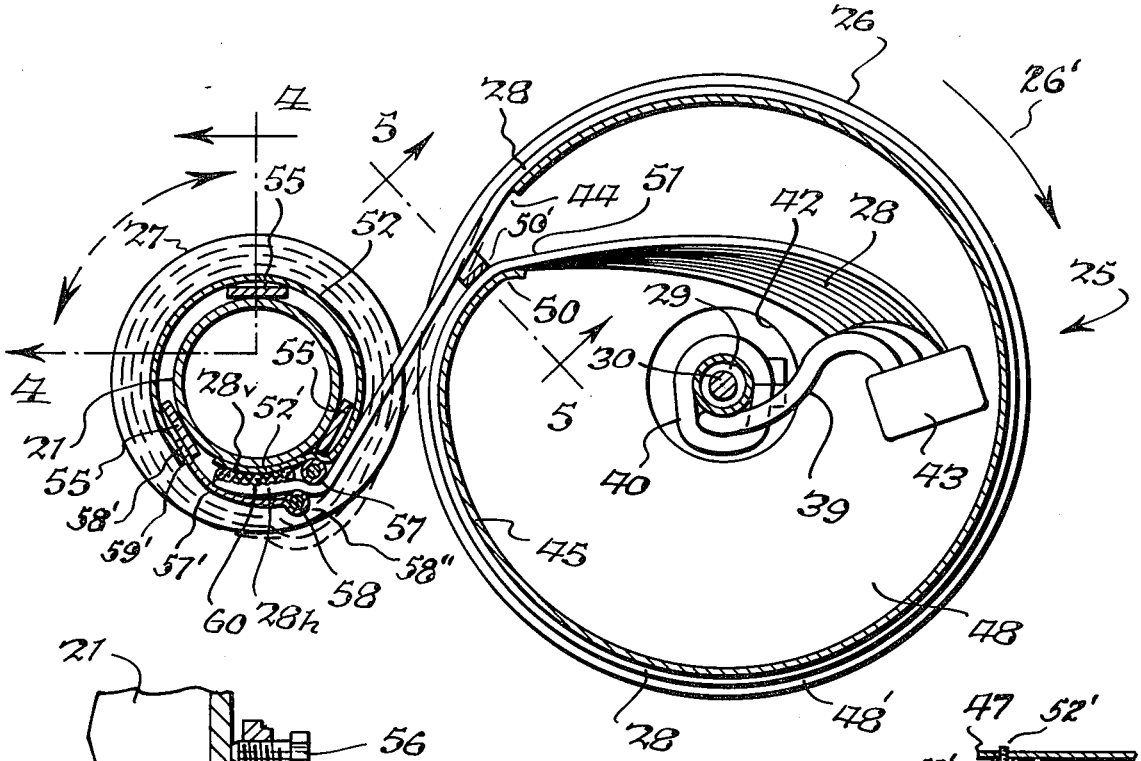
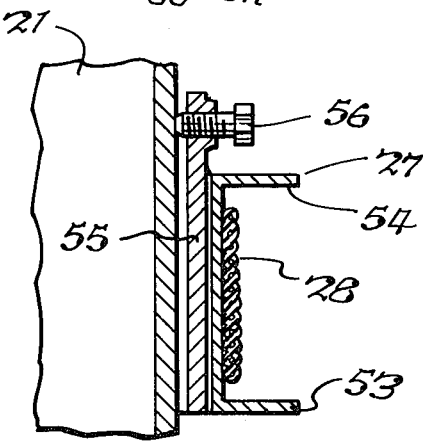
Fig. 4.
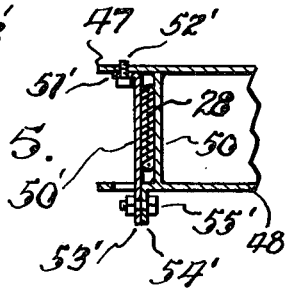
Fig. 5.
Fig. 6.
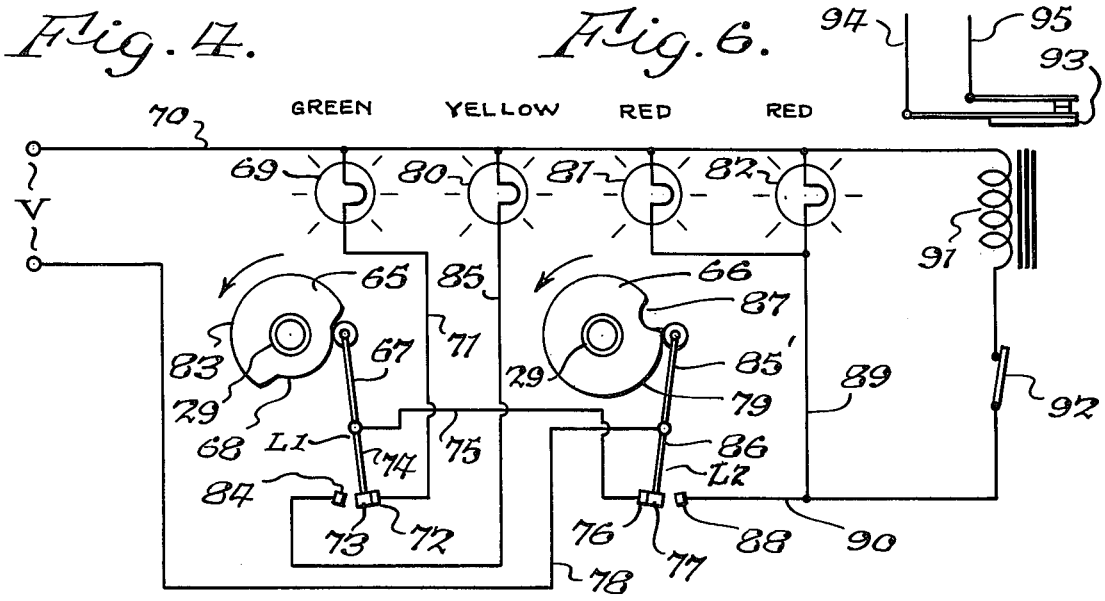

ELECTRICAL INSTALLATION FOR FIRE ENGINE TOWER OR THE LIKE

BACKGROUND OF THE INVENTION

The present invention relates to an improved electrical installation for a fire engine, rotating derrick, crane, or the like, mounting a rotatable tower.

By way of background, certain types of fire engines have a ladder tower mounted on the rear thereof. The ladder tower permits a man to climb the ladder and the ladder tower also contains a water conduit terminating at a nozzle at the upper end of the tower for directing water at a fire. The electrical connections between a fire engine body and the tower consists of many wires, generally about 20, for the purpose of providing remote nozzle controls, remote ladder controls, and for an intercommunication system. During the course of using the ladder tower it is rotated about a vertical axis. Therefore, the electrical connections between the fire engine body and the ladder tower have to be of the type which permit such rotation. In the past, a slip ring system was used, as is common between a rotatable part and a stationary part. However, the slip rings in the present environment were subject to certain shortcomings. The slip rings were subject to dirt and therefore could occasionally fail to complete a circuit. In addition, they were subject to corrosion and wear and misadjustment so that the desired dependability of electrical communication was not achieved. Furthermore, the same problem existed relative to rotating derricks, cranes and analogous devices. It is with the overcoming of the foregoing deficiencies of electrical installations in devices of the foregoing type that the present invention is concerned.

SUMMARY OF THE INVENTION

It is accordingly one object of the present invention to provide an improved electrical installation for a rotatable device, such as the tower of a fire engine, which permits the use of continuous wiring between the device and the body on which it is mounted.

Another object of the present invention is to provide an improved electrical installation between a body and a rotatable device mounted thereon, such as the tower of a fire engine, which permits the device to experience a predetermined number of rotations without stressing the wires extending between the body and the device.

A further object of the present invention is to provide an improved electrical installation for a rotatable device, such as the tower of a fire engine, which possesses an improved signaling system which generally indicates the number of turns which the device has made to thereby alert the operator against turning the device too many times in any single direction.

Yet another object of the present invention is to provide an improved electrical installation for a rotatable device such as the tower of a fire engine in which the electrical circuit for rotating the tower is deenergized when the tower has been rotated too great a number of turns in a predetermined direction. A related object of the present invention is to provide an electrical installation in which there is a manual overide which permits the tower to be returned to a desired position after the rotation has been terminated automatically. Other objects and attendant advantages of the present invention will readily be perceived hereafter.

The present invention relates to a construction comprising a body, a rotatable tower mounted on said body, continuous wiring connections between said body and said rotatable tower, and signal means for indicating the extent to which said tower has been rotated from a predetermined position. The construction also includes means for terminating the electrical connection to the tower rotating circuit when said tower has been rotated a given amount from a neutral position and means for overriding said means for terminating said electrical connection to the tower rotating circuit.

The present invention also relates to an electrical installation for a rotatable tower comprising a frame, a first drum having a hub portion and an outer surface pivotally mounted on said frame, means biasing said first drum to a central position, a second drum offset laterally from said first drum, a rotatable member mounting said second drum for turning with said tower, a plurality of wires on said outer surface of said first drum, means for attaching said plurality of wires to said second drum, and means for conducting said electrical wires from said second drum into said rotatable tower, said first drum having a diameter which is greater than the diameter of said second drum whereby said second drum can rotate a plurality of turns for each turn of said first drum.

The various aspects of the present invention will be more fully understood when the following portions of the specification are read in conjunction with the following drawings wherein:

BRIEF DESCRIPTION OF THE DRAWINGS

FIG. 1 is a fragmentary perspective view of a fire engine mounting a rotatable tower;

FIG. 3 is a fragmentary cross sectional view taken substantially along line 3—3 of FIG. 2 and showing details of the drums which mount the wires;

FIG. 4 is a fragmentary cross sectional view taken substantially along line 4—4 of FIG. 3;

FIG. 5 is a fragmentary cross sectional view taken substantially along line 5—5 of FIG. 3 and showing the clamp for securing the wire ribbon to the drum;

FIG. 6 is a schematic wiring diagram of the indicating and cut-out circuit for the tower;

FIG. 7 is a view showing how the cables are coiled about the drum supporting shaft after it has rotated one complete revolution; and FIG. 8 is a schematic diagram showing the drums in a neutral position.

DESCRIPTION OF THE PREFERRED EMBODIMENTS

Figure 2:
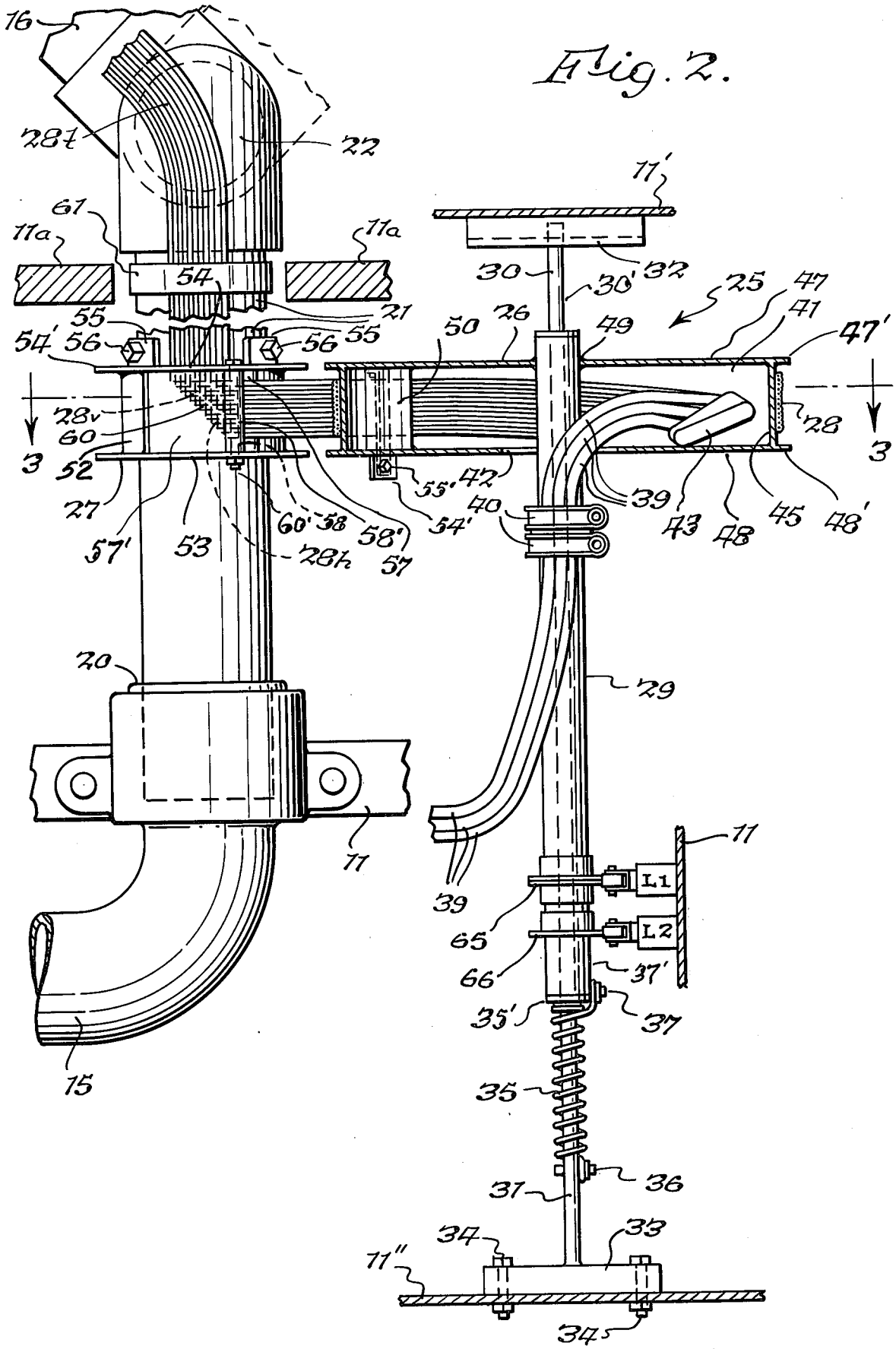
FIG. 2 is a fragmentary cross sectional view taken substantially along line 2—2 of FIG. 1 and showing the improved wiring between the frame of the fire engine and the rotatable tower.

While the following description is directed to a fire engine, it will be appreciated that the principles of the present invention are applicable to rotating derricks, cranes, and the like, wherever continuous electrical wiring is required.

As is well understood, the fire engine 10 of FIG. 1 includes a vehicle body 11 mounting a ladder tower 12. When at the site of a fire, the hoses 13 are connected to a hydrant 14 and hoses 13 in turn are in communication with conduit 15 within vehicle body 11 (FIG. 2). Conduit 15, in turn, is in communication with conduit 16 leading to nozzle 17 at the top of the ladder tower 12.

Ladder tower 12 is mounted in the conventional manner on a turret 18 mounted on the vehicle body 11. As is well understood, tower 12 can rotate about a vertical axis, as is required in operation so that nozzle 17 can direct a jet 19 in any desired direction. The rotation is permitted because of a rotatable seal 20 (FIG. 2) between conduit 15 and conduit 21 leading to conduit 16. A flexible connection 22 is located at the junction of conduits 21 and 16 to permit ladder tower 12 to pivot, as required, about a horizontal axis.

It is necessary to have a plurality of electrical wires extending between fire engine body 11 and the area of nozzle 17. These wires are necessary for controlling the ladder tower 12 and the position of nozzle 17 from a remote position. By way of example, in a specific installation nine wires are used for the remote ladder controls, ten wires are used for remote nozzle controls, and two wires are used for an intercom. The wires are generally attached to conduit 16 so that they rotate with conduit 16.

In the past, in order to have electrical connections between the wires on vehicle body 11 and wires attached to conduit 16, slip rings were used. However, slip rings were subject to certain shortcomings, namely, they could get dirty and therefore electrical contact could be lost. In addition, the slip rings could get worn or corroded or otherwise have their efficiency imparied. This could result in serious malfunctions of ladder tower 12, either in its ability to rotate or in the ability of nozzle 17 to be directed and operated properly.

In accordance with the present invention, and improved wiring installation is provided which overcomes the deficiencies of a slip ring type of structure. In this respect, the wiring connections between the vehicle body and the ladder tower 12 are continuous, that is, there is no break in the wiring, as is the case with slip rings. The wiring installation is such that the ladder tower 12 can rotate three complete revolutions to the right or to the left of a given neutral position. In other words, it can rotate 1,080° clockwise or 1,080° counterclockwise without straining the continuous wires extending between the vehicle body 11 and ladder tower 12.

In order to obtain the foregoing results a wiring installation 25 is used. Essentially it consists of a large diameter drum 26 cooperating with a small diameter drum 27, between which a ribbon 28 consisting of multiple wires extends. More specifically drum 26 is fixedly mounted to shaft 29 which in turn is coaxially mounted on spindle 30' having an upper portion 30 and a lower portion 31. Upper spindle portion 30 is supported in block 32 mounted on vehicle frame portion 11'. Lower spindle 31 is secured to block 33 which in turn is bolted to vehicle frame portion 11'' by means of bolts 34. Shaft 29 is pivotally supported on spindle 30'. A spring member 35 has its lower end fixed to spindle 30' by pin 36 and its upper end fixed to shaft 29 by pin 37. Spring 35 causes drum 26 to occupy a predetermined neutral circumferential position on shaft 30' and any rotation of drum 26 in a counterclockwise direction in FIG. 3 will be against the bias of spring 35. Whenever the force tending to rotate drum 26 is released, spring 35 will return drum 26 in a clockwise direction 26' to a neutral position. Washer 35' is welded to shaft 31 and supports bearing 37' on shaft 29 in a given vertical position.

A plurality of cables 39 lead from the control panel (not shown) at the front of fire engine 10 and are clamped to shaft 29 by clamps 40. Cables 39 lie loosely relative to shaft 29 (FIG. 2) so that shaft 29 can rotate a full 360° in either direction without stressing cables 39, as shown in FIG. 7. However, it will be appreciated that the cable should not be wound around shaft 29 an excessive amount. Otherwise, the wiring could be torn.

Cables 39 extend into the inner chamber 41 of drum 26 through central aperture 42 and they terminate at a connector 43. The terminals of a ribbon conductor 28 are connected to connector 43 and they lead through circumfereitial opening 44 on the cylindrical wall portion 45 of drum 26, the cylindrical portion being located between top plate 47 and lower plate 48 in which aperture 42 is located. Upper plate 47 is welded to shaft 29 at 49, whereby shaft 29 will rotate with drum 26.

As can be seen from FIG. 3, the aperture 44 in drum wall 45 permits ribbon 28 to be passed around the periphery of cylindrical portion 45 of the drum. Lower plate 48 terminates at a flange 48' and upper plate 47 terminates at a flange 47' so as to prevent ribbon 28 from moving off of drum surface 45 in an axial direction. It is to be especially noted that cylindrical portion 45 terminates at an inwardly turned lip 50 to permit the portion of ribbon 28 at 51 to smoothly traverse the zone between the inside of drum 26 and the outside of drum 26. The ribbon 28 is secured to lip 50 of cylindrical portion 45 by clamp 50' which (see FIG. 5) has flange 51' thereof attached to top plate 47 by screw 52'. The lower portion 53' of clamp 50' is attached by screw 55' to tab 54', which is bent downwardly from lower plate 48.

Small diameter drum 27 includes a cylindrical surface 52 mounted between parallel annular flanges 53 and 54. Lugs 55, which are suitably attached to the internal drum surface 52, as by welding, receive screws 56 which affix drum 27 to rotatable conduit 21 which rotates with ladder tower 12. As can be seen from FIGS. 2 and 3, ribbon 28, which carries as many as twenty-one wires, passes between cylindrical surfaces 57 and 58''. Ribbon 28 is folded at right angles to itself at 60. In this respect, the horizontal portion of the ribbon 28 is shown at **28*h* and the vertical portion of the ribbon in this area is shown at 28*v*. A clamping plate 57' has one end 58' which is received between lug 55 and portion 59' of cylindrical surface 52. The other end of plate 57' is formed into a loop 58'' and fits about pin 58, which is a bolt having a nut 60' at its lower end, the bolt extending between flanges 53 and 54. Clamping plate 57' holds ribbon portions 28*h*–28*v* in position on drum 27. As drum 27 rotates, it will pull ribbon 28 from drum 26 against the bias of spring 35. Cylindrical surfaces 57–58'' cause ribbon 28 to bend gradually regardless of the direction of rotation of drum 27**.

As can be seen from FIG. 3, drum surface 52 is indented at 52' so as to permit ribbon 28 to make the right angle bend at **28*h*–28*v* without creating an excessive bulge in this area. In other words, the indentation at 52' essentially provides a pocket for the right angle turn of ribbon 28 at area 60. In addition, the indentation 52' leaves an open space between surface 52 and flange 54 so as to permit ribbon portion 28 to pass upwardly along conduit 21**.

In accordance with the present invention, drum 27 is one-third the diameter of drum 26. In other words, drum 26 can carry three times the length of ribbon 28 thereon for each complete winding of ribbon 28 on drum 27. This being the case, if drum 27 should make three complete revolutions, drum 26 will Make only one complete revolution. The significance of this is that pipe 21 on which smaller drum 27 is mounted can turn three complete times or a total of 1,080° while drum 26 turns a total to 360°. As can be seen from FIG. 7, a 360° turning of drum 26 will be accompanied by only a single turning of cables 39 around shaft 29. At this point it is to be especially noted that ribbon portion **28*t* which leads to tower 12 is of extremely small thickness so that it can pass through the relatively small clearance at fire engine frame portion 11*a*, this clearance being on the order of five-sixteenths of an inch. It is also to be noted that wire ribbon portion 28*t* may be attached to conduit 21 by bands, such as 61 and similar bands attach ribbon portion 28*t* to conduit 16 which extends up the tower 12. It is also to be noted that the portion of ribbon 28*t* in the area of flexible connection 22 is sufficiently slack so that it will not be ruptured by movement of pipes 16 and 21** relative to each other at the flexible connection.

In FIGS. 2 and 3 the various parts are shown in the position which they occupy after drum 27 has rotated about 90° clockwise from its neutral position shown in FIG. 8. Normally when the ladder tower 12 is stowed on the truck so that it extends along the longitudinal axis thereof, the ribbon 28 will be in the position schematically shown in FIG. 8 wherein it points toward the center of drum 27. At this time drum 26 will have approximately one complete turn of ribbon 28 thereon. Thus, drum 27 can move either in a clockwise direction **27*x* or a counterclockwise direction 27*y* for a full 1,080° before the winding on drum 26 is exhausted. As noted briefly above, as drum 27 turns in either direction from the neutral position of FIG. 8, it will take ribbon 28 off of drum 26. Regardless of the direction in which drum 27 turns, drum 26 will turn in a counterclockwise direction in FIG. 3. The ribbon 28 taken from drum 26 is against the bias of spring 35 so that spring 35 will cause drum 26 to rotate in direction 26'** back to its neutral position shown in FIG. 8.

During the course of using ladder tower 12, it may rotate more than 360° under the control of an operator who is located either at the top of ladder tower 12 or at a remote position at the control panel (not shown) of fire engine 10. If tower 12 should rotate more than 1,080°, there is the possibliity of rupturing the electrical lines. Accordingly, a signal system and automatic cutout circuit is provided to prevent this occurrence. More specifically, cams 65 and 66 are fixedly mounted on shaft 29 (FIGS. 2 and 6). Cam 65 works in conjunction with limit switch $L_1$ and cam 66 works in conjunction with limit switch $L_2$, said switches being mounted on the frame 11 of the fire engine. Lamps 69, 80 and 81 on the control panel and lamp 82 on the rear of the fire engine will be lit at appropriate times, as explained hereafter.

During the first 115° of rotation of cam 65, switch arm 67 of switch $l_1$ will follow surface 68 of cam 65. During this period the ladder tower will be within 345° of its neutral position in either direction. To signify that this is the case, a green lamp 69 will remain lit because of circuit will be completed from voltage source V through lead 70, lamp 69, lead 71, closed switch contacts 72 and 73, switch arm 74, lead 75, closed switch contacts 76 and 77, switch arm 86 and lead 78 back to the voltage source. It will be appreciated that cam 66 will also rotate approximately 115° with cam 65 because it is mounted on the same shaft 29. However, cam surface 79 is such that switch contacts will remain closed during this rotation. While switch arm 67 remains on cam portion 68, lamps 80, 81 and 82 in the indicating circuit will remain off. It can thus be seen that ladder tower 12 can rotate 345° in either direction from the neutral position of FIG. 8 and during this time green lamp 69 will remain lit. The neutral position is when the ladder tower 12 is pointing toward the cab of engine 10 and, in this situation, drums 26 and 27 are in the position shown in FIG. 8. Since the green light is on for only 345°, it is impossible to stow the ladder in any other position of drums 26 and 27 shown in FIG. 8 when it is stowed with the green light on.

If ladder tower 12 should exceed 345° of travel in either direction from the neutral position, switch arm 67 will ride up onto portion 83 of cam 65. This will cause switch contacts 72 and 73 to open to terminate the circuit to green lamp 69. However, contact 73 will engage contact 84 to complete a circuit through yellow lamp 80 from the voltage source V via lead 70, lamp 80, lead 85, now closed contacts 73 and 84, switch 74, lead 75, closed contacts 76 and 77, switch 86 and lead 78 back to the voltage source. Since cam surface 83 is approximately 185° and since switch arm 85' of switch $L_2$ will continue to ride on surface 79 during this 185°, the yellow light will remain on for 555° of rotation of the ladder tower, that is, about one and one-half revolutions in either direction from a position where it had already rotated 345° in the same direction from a neutral position.

Thus after tower 12 has rotated 900° in one direction from the neutral position, a point will be reached where arm 85' of switch $L_2$ will drop onto surface 87 of cam 66 to cause contact 77 to engage contact 88. This will break the circuit to yellow lamp 80 and will complete a circuit through red lamps 81 and 82 from voltage source V through lead 70, parallel lamps 81 and 82, lead 90, now closed contacts 77 and 88, switch arm 86, and lead 78 back to the voltage source. The lighting of the red lamps will indicate that the ladder tower has rotated 900° from its neutral position. At the same time a circuit will be completed through solenoid 91 and switch 92 which are connected in parallel across red lamps 81 and 82. This will open switch 93 to terminate the flow of current through leads 94 and 95 which are in the rotation valve coil circuit for the ladder tower 12 and thus ladder tower 12 will stop in the position in which it was last placed before switch 93 opened. The reason for preventing continued rotation of tower 12 is to prevent rupturing of the continuous electrical leads, namely, cables 39 and ribbon 28.

In order to reenergize the rotation valve coil circuit, that is, to close switch 93, switch 92 is manually opened to deenergize solenoid 91, which in turn causes switch 93 to reclose. At this time the tower can be moved in either direction, as required to get the tower back to a safe position. In this respect, since the power was shut off at 900°, and since there is enough wire on drum 26 to allow for 1,080° rotation of drum 27, there is a reserve of 180° of rotation in drum 27 to permit the tower to be manipulated in either direction to get it back to a safe position. Lamps 81 and 82 will turn off as soon as switch arm 85' moves back onto cam surface 79. At this time yellow lamp 80 will turn on and it will stay on for about one and one-half complete revolutions of tower 12 and at the end of such revolutions switch arm 67 will again drop onto cam surface 68 to turn green lamp 60 on. At this time tower 12 can be turned another 345° to bring it back to its neutral position from which it can start operating again in either direction. Alternately, if desired, once green light 69 is turned on, ladder tower 12 can be placed back into use without rotating it another 345° back to about its neutral position. Switch 92 is preferably located at the rear of fire engine 10 in a closed compartment. Red lamp 82 is also located at the rear of the fire engine so that the person manipulating switch 92 can see why lamp 82 goes off.

While only one green and yellow lamp and two red lamps have been shown in FIG. 6, it is preferable to have two green, two yellow and four red lamps, so that each lamp has a duplicate lamp in parallel therewith to provide dependability of visual formation in the event of lamp failure. Furthermore, drums 26 and 27 are mounted under the tower base so that they are protected from ice, mud, snow or contact with anything which might damage them.

It can thus be seen that the improved electrical installation of the present invention is manifestly capable of achieving the above enumerated objects and while preferred embodiments of the present invention have been disclosed, it will be appreciated that the present invention is not limited thereto but may be otherwise embodied within the scope of the following claims.

What is claimed is:

1. An electrical installation for a rotatable tower comprising a frame, a first drum pivotally mounted on said frame and having a hub portion and an outer surface, means biasing said first drum to a central position, a second drum offset laterally from said first drum, a rotatable member mounting said second drum for turning with said tower, a plurality of wires on said outer surface of said first drum, means for attaching said plurality of wires to said second drum, and means for conducting said plurality of wires from said second drum into said rotatable tower, said first drum having a diameter which is greater than the diameter of said second drum whereby said second drum can rotate a plurality of turns for each turn of said first drum.

2. An electrical installation as set forth in claim 1 wherein said plurality of wires on said outer surface of said first drum and said second drum are in the form of a ribbon.

3. An electrical installation as set forth in claim 1 including signal means fo indicating when said tower has turned a predetermined amount.

4. An electrical installation as set forth in claim 3 wherein said signal means comprises electric circuit means including switch means actuated in response to the turning of said tower said predetermined amount, and lamp means actuated by said switch means.

5. An electrical installation as set forth in claim 4 wherein said lamp means comprises first and second lamps, and wherein said first lamp is actuated during a first predetermined portion of the turning of said tower and wherein said second lamp is actuated beyond said first predetermined portion of turning of said tower.

6. An electrical installation as set forth in claim 5 including third lamp means actuated after said tower turns beyond a second predetermined portion beyond said first predetermined portion of turning of said tower.

7. An electrical installation as set forth in claim 3 including circuit means for deenergizing said tower from additional rotation when it has rotated a predetermined amount.

8. An electrical installation as set forth in claim 7 including manually actuated switch means for reenergizing said tower for additional rotation to thereby override said circuit means.

9. An electrical installation as set forth in claim 2 wherein said first drum includes an upper plate and a lower plate, a shaft fixedly secured to one of said plates and an opening in the other of said plates, means pivotally mounting said shaft on said frame, cable means in contiguous relation to said shaft and extending into said first drum through said opening, and connector means between said cable means and said ribbon.

10. An electrical installation as set forth in claim 9 including a second opening in said outer surface of said first drum to permit said ribbon to pass from the inside of said first drum to the outside thereof, and clamp means for clamping said ribbon to said outer surface.

11. An electrical installation as set forth in claim 11 wherein said outer surface in the area of said second opening provides a smooth lip portion.

12. An electrical installation as set forth in claim 12 wherein said clamp means is located at said smooth lip portion.

13. An electrical installation as set forth in claim 13 wherein said second drum includes a second outer surface, said ribbon being folded at a right angle to itself on said second outer surface, and second clamp means for clamping said ribbon folded at a right angle to itself to said second outer surface.

14. A construction comprising a body, a rotatable tower mounted on said body, a tower rotating circuit including continuous wiring connections between said body and said rotatable tower, signal means for indicating the extent to which said tower has been rotated from a predetermined position, an electrical connection in said tower rotating circuit, means for terminating said electrical connection to the tower rotating circuit when said tower has been rotated a given amount from said predetermined position, and means for overriding said means for terminating said electrical connection to the tower rotating circuit.

* * * * *

UNITED STATES PATENT AND TRADEMARK OFFICE

CERTIFICATE OF CORRECTION

PATENT NO. : 4,065,761

DATED : December 27, 1977

INVENTOR(S) : Richard E. Young and Timothy D. Ostolski

It is certified that error appears in the above-identified patent and that said Letters Patent are hereby corrected as shown below:

Column 3, line 22, after "and" insert --the--;
line 32, change "and" to --an--.
Column 4, line 67, change "Make" to --make--.
Column 5, line 3, change "to" to --of--;
line 55, change "$l_1$" to --$L_1$--;
line 59, change "of" to --a--.
Column 6, line 34, after "82," insert --lead 89,--;
line 64, change "60" to --69--.
Column 7, line 11, change "formation" to --information--;
line 43 (claim 3), change "fo" to --for--.
Column 8, line 29 (claim 11), change "11" to --10--;
line 32 (claim 12), change "12" to --11--;
line 35 (claim 13), change "13" to --12--.

Signed and Sealed this

Ninth Day of May 1978

[SEAL]

Attest:

RUTH C. MASON
Attesting Officer

LUTRELLE F. PARKER
Acting Commissioner of Patents and Trademarks